US005656875A

United States Patent [19]

Hutson

[11] Patent Number: 5,656,875

[45] Date of Patent: Aug. 12, 1997

[54] CREATING INDEPENDANCE VIA ELECTRONICALLY PRESENTED INFORMATION SEGMENTS

[75] Inventor: Adam Hutson, Dortmund, Germany

[73] Assignee: Adam Hutson Research

[21] Appl. No.: 615,075

[22] Filed: Mar. 4, 1996

Related U.S. Application Data

[63] Continuation of Ser. No. 174,882, Dec. 27, 1993, abandoned.

[51] Int. Cl.[6] ..... H01H 43/00

[52] U.S. Cl. ..... 307/113; 307/139; 307/149

[58] Field of Search ..... 307/64, 66, 112, 307/113, 115, 116, 125, 139, 140, 141, 141.4, 141.8, 149, 132 R, 132 M, 134; 365/226, 227, 228, 229

[56] References Cited

U.S. PATENT DOCUMENTS 4,490,711 12/1984 Johnston ..... 340/309.4

4,712,019 12/1987 Nilssen ..... 307/141

5,241,680 8/1993 Cole et al. ..... 395/750

*Primary Examiner*—William M. Shoop, Jr.

*Assistant Examiner*—Jonathan S. Kaplan

[57] ABSTRACT

This device is for the creation of independance from human instruction using a self-contained, wearable electronic device and automatic presentations of prerecorded audio and, or audiovisual information at predesignated, beneficial times. Messages can be presented in easily understood parts and at a rate comfortable to the user. The simulating messages containing any useful combinations of human voice, visual imagery, musical tones, ect., can be automatically presented an appropriate number of times for the given user. The device also concerns power savings in multiple circuit systems such that circuits of varying power requirements, as defined by their functionality, are able to deactivate each other for the express purpose of power conservation. In the case of separate batteries per circuit, low power circuits do not drain power away from the batteries of other circuits that require their batteries to provide high bursts of power for short intervals of time.

6 Claims, 9 Drawing Sheets

"PRIOR ART"

"PRIOR ART"

CREATING INDEPENDANCE VIA ELECTRONICALLY PRESENTED INFORMATION SEGMENTS

Figure 1:
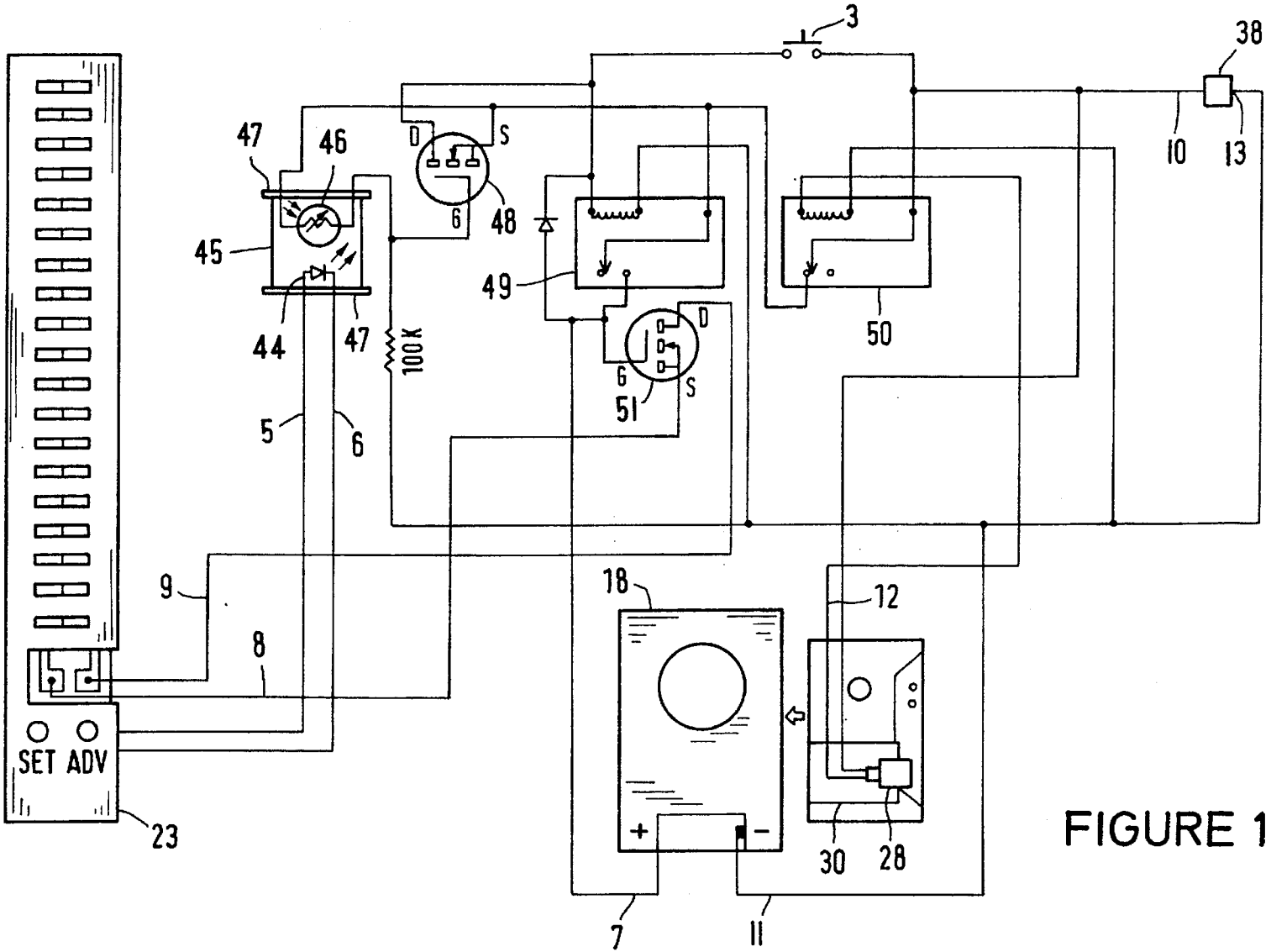

This application is a continuation of Ser. No. 08/174,882, filed Dec. 27, 1993, now abandoned.

BACKGROUND

1. Field of Invention

This invention relates to timely, automated, custom, audio and or audio-visual messages presented in a combination of user-familiar sounds, voices, images, repeated as necessary as storage space allows. The method, with device, can present information for guiding, teaching, re-orienting, and or emotionally comforting the user, such that they are substantially more independent of assistance from others at designated times. Both healthy and impaired persons can utilize the device. Information can be presented in a variety of ways including an integral speaker, earphones and or LCD Video displays. It also relates to electronic facilitating devices that are non-invasive, and portable in nature and are designed to be worn by the user but require no intervention from them and are otherwise sealed and locked to persons not having a cabinet key. The device facilitates the easy creation and programming of the messages and play routines, when disassembled, and requires low maintenance of it's batteries as a result of the circuit design.

2. Description of Prior Art

Many persons require a constant and or intermittent supply of certain types of information or instructions, presented in an identifiable, emotionally constructive manner, on a routine basis. For example, persons suffering from a cognitive deficiency as a result of a head injury, or mental retardation, often forget to engage in daily hygiene activities without constant or intermittent instructions and therefore supervision of caregivers. Individual instructions must often be repeated for the user causing frustration for both the patient and caregiver. Repetition of a structure of daily routines, with timely modifications, may bolster the user's mastery of basic living skills.

Consumers who wish to record information, and be automatically presented with it later, must do this by typing information into a computer, or electronic planner and use an established lengthy software procedure. Therefore, lack of typing and computer skills can retard the user's progress.

Caregivers who work out of the home; or teaching professionals, who must supervise a large number of patients or students, often spend time supplying, and repeating, at precisely the right instant and pace, pieces of information.

Various attempts have been made to record and provide these sets of information at the correct times including the use of paper lists in conjunction with alarm clocks, notes in key locations, ect. Electronic beepers (U.S. Pat. No. 4,490,711) 1981, have been used to capture the attention of a user and provide a reference number, via an Liquid Crystal Display, relating to a list or pill tray for the designated time. Mother device, which the inventor believes may have been patented in Denmark, provides an electronic alarm until the user chooses one of several written cards, listing the appropriate activity for that time, and places it in a slot in the device.

Aside from the instructional methods and aids already discussed, all process's and facilitating devices heretofore known suffer from the same disadvantages:

(a) All systems require the user to execute a combinations of cognitive and physical skills, such as reading and placing cards in a slot, which are superfluous to the message's meaning and have to be done before the message can be effective.

(b) All systems can only repeat one set of information messages each time it calls attention to itself. The message cannot change during the time that the user is paying attention to it.

(c) All systems are not portable and wearable in their entirety.

(d) All systems do not have customized, pre-designated limits as to how many times or how much time the user will be exposed to it, whereby they may be over-exposed and become agitated or under-exposed and fail to grasp the information.

(e) All systems do not possess the capability to store and present "reality-recreation" audio and or audio-visual images.

(f) All devices are limited to presenting one or two types of somewhat in-effective information such as an electronic beeper and written information.

(g) All devices call attention to themselves, in the same continuous manner each time, which causes users to become less responsive to the actual information conveyed.

(h) All devices require some degree of superfluous knowledge of a device or skill such as typing or writing in order to receive and or understand the information.

(i) All systems do not allow the information to be given in increments, and at a rate, that is most beneficial to the particular user.

(j) All systems do not have complete sets of information stored on a re-moveable, compact storage media.

OBJECTS AND ADVANTAGES

Several advantages of the present invention are:

(a) In operation, my process and device are anthroprometrically-compatible, self-contained, single part solutions that the user can retain on their person for long periods of time.

(b) Users are not required to perform device-oriented, superfluous tasks to receive the full message whereby the user can concentrate on understanding and or acting on the message.

(c) Messages can be broken up into digestible increments and be presented at a pace that is acceptable to a particular user.

(d) The amount of time and or number of times that a person is exposed to the device, or a message or it's parts, can be pre-designated.

(e) Messages, each of a unique length and design, can contain any useful combination of harmonic tones, visual signals or icons, recorded voices, intermissions, and images within that information segment.

(f) The user may be exposed to a message that varies in form or content each time that they listen to it.

(g) These automatically played 'routines' can be semi-permanently created in other locations with easily-accessible technology. Furthermore, they can be installed and run with little set-up time, (h) Infinite opportunity to quickly change the recorded information, therefore preventing the user from becoming desensitized to it.

(i) The high maintenance batteries (4 AA) can be removed with the timer/alarm's retaining the time of day. The time keeping function, which remains on at all times, does not deplete the high maintenance batteries (4 AA).

DRAWING FIGURES

FIG. 1 Circuit Schematic

Figure 2:
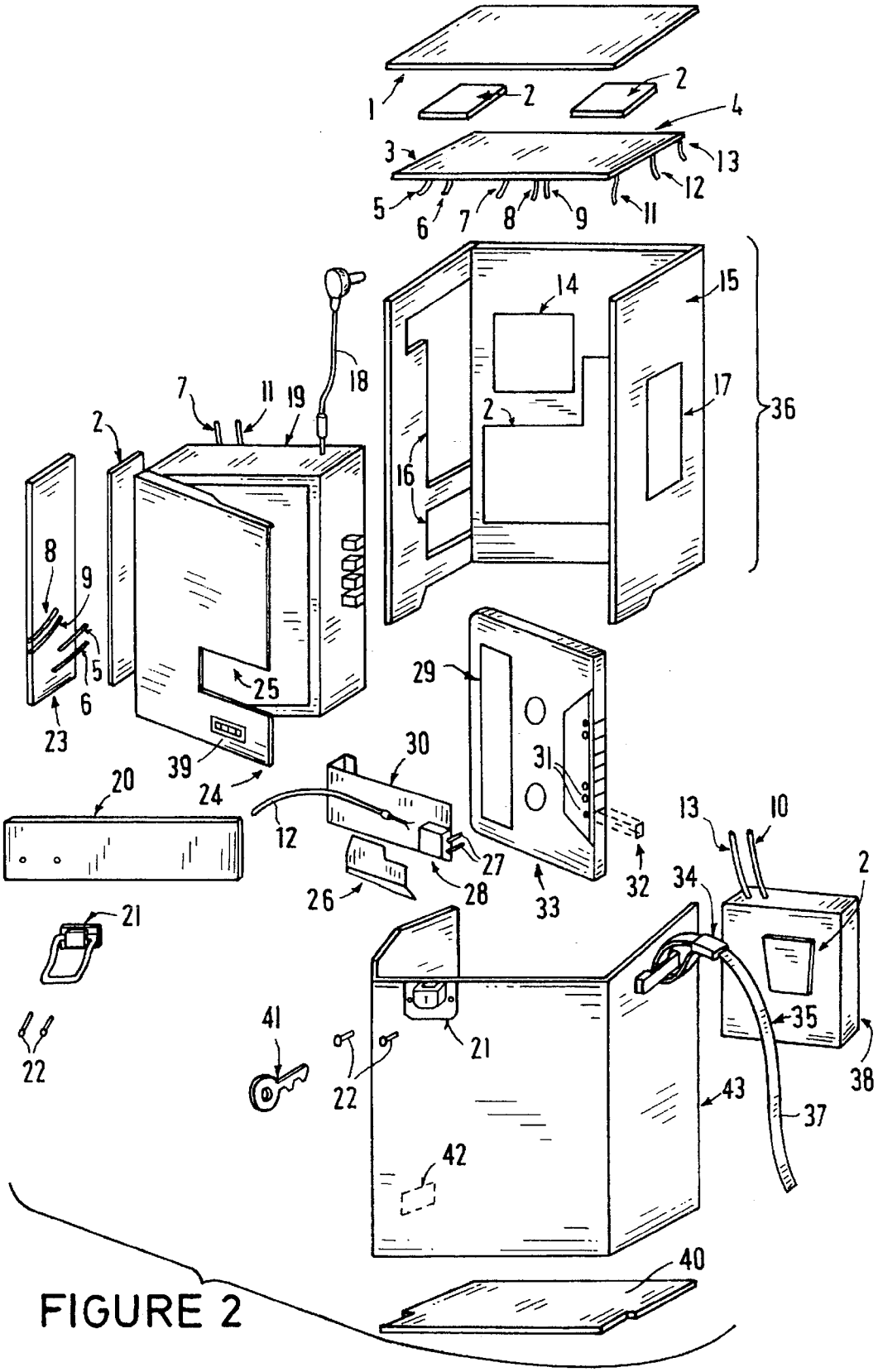

FIG. 2 Exploded View, Standard Cassette Version

Figure 3B:
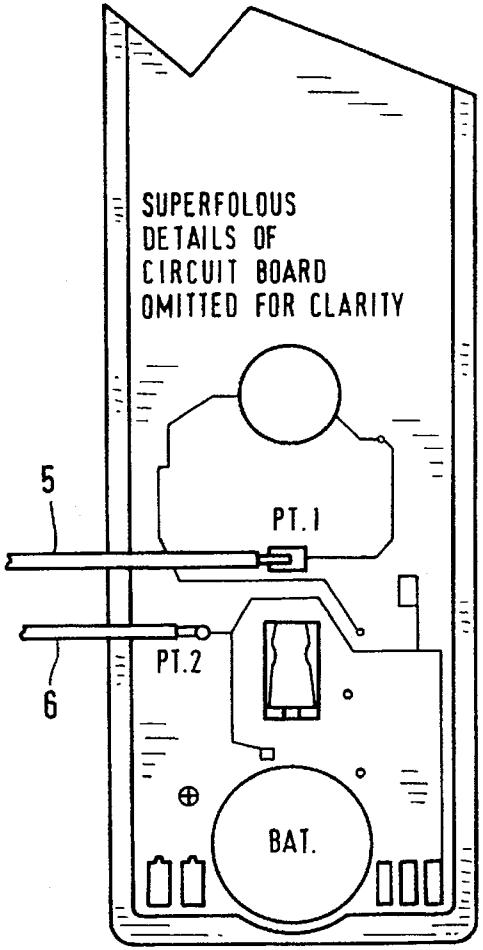
Figure 3A:
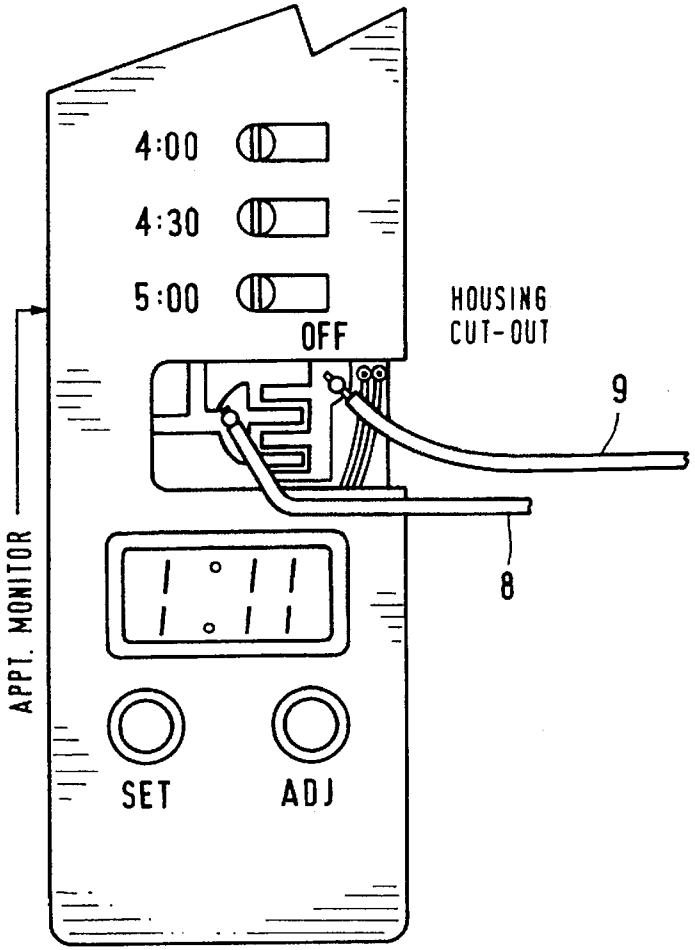

FIGS. 3A and 3B Wire Connections to "Appointment Monitor"

Figure 4:
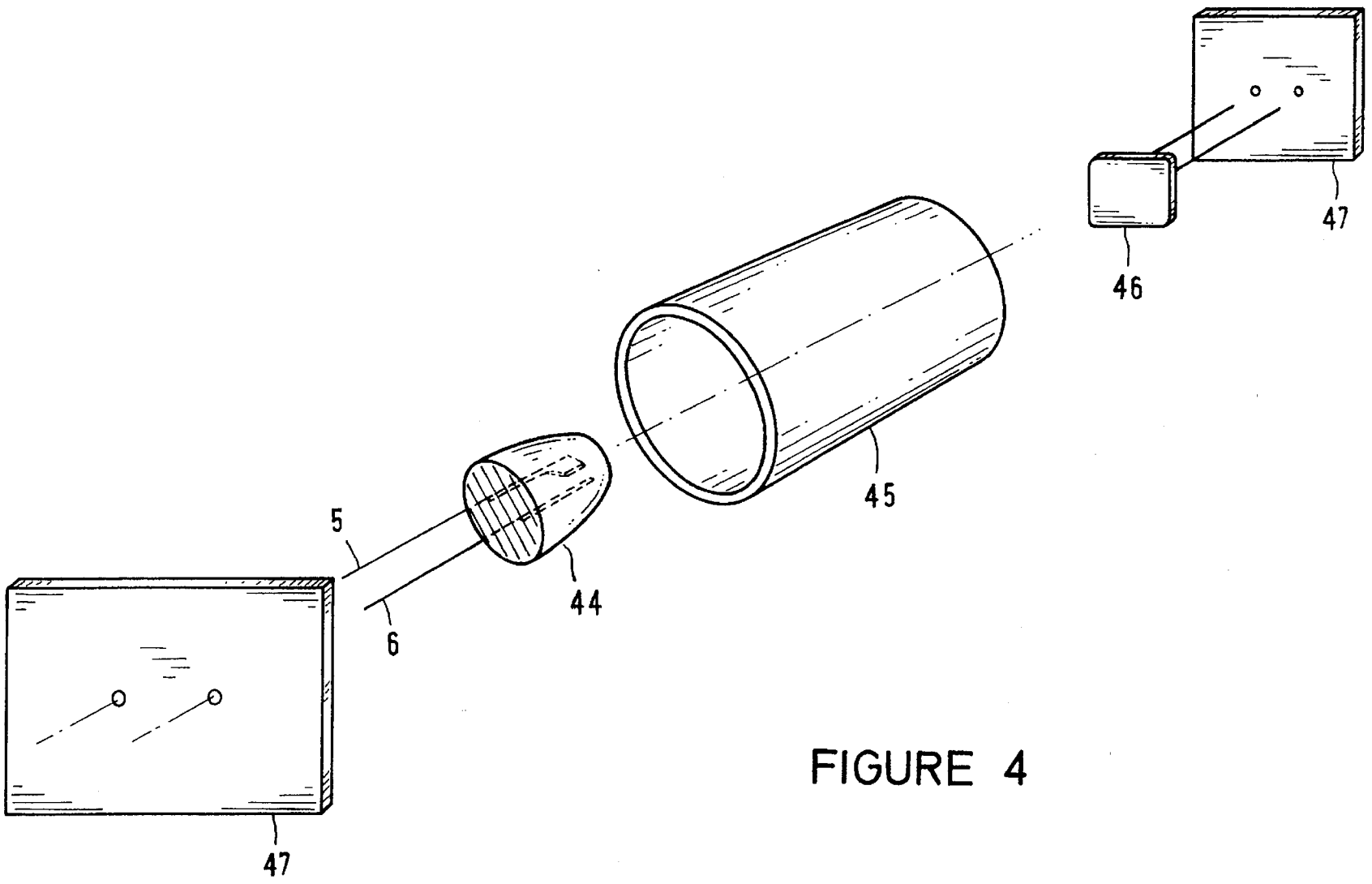

FIG. 4 Exploded View, Opto-Isolator

Figure 5:
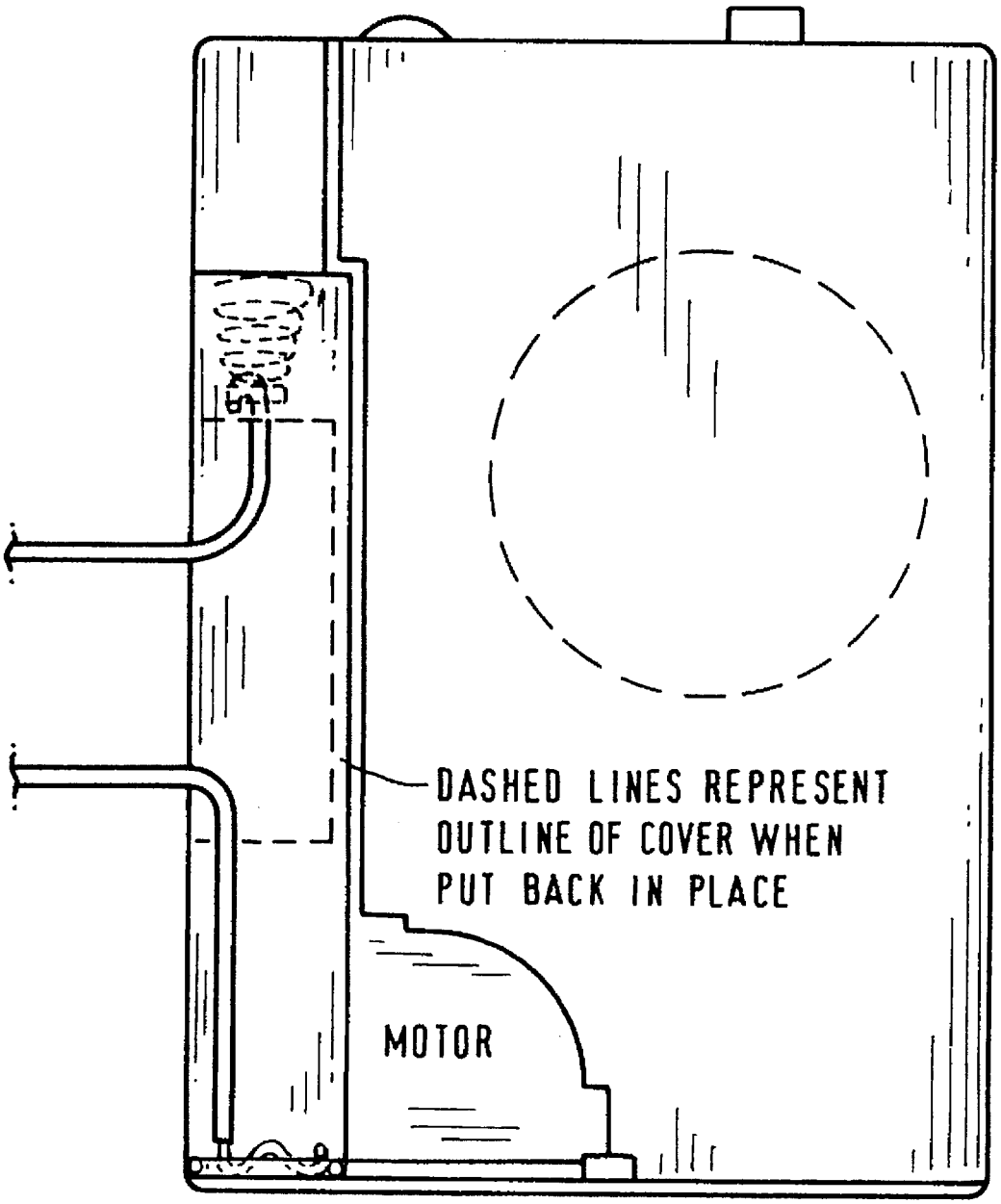

FIG. 5 Wire Connections To Tape Recorder's Battery Terminal

Figure 6:
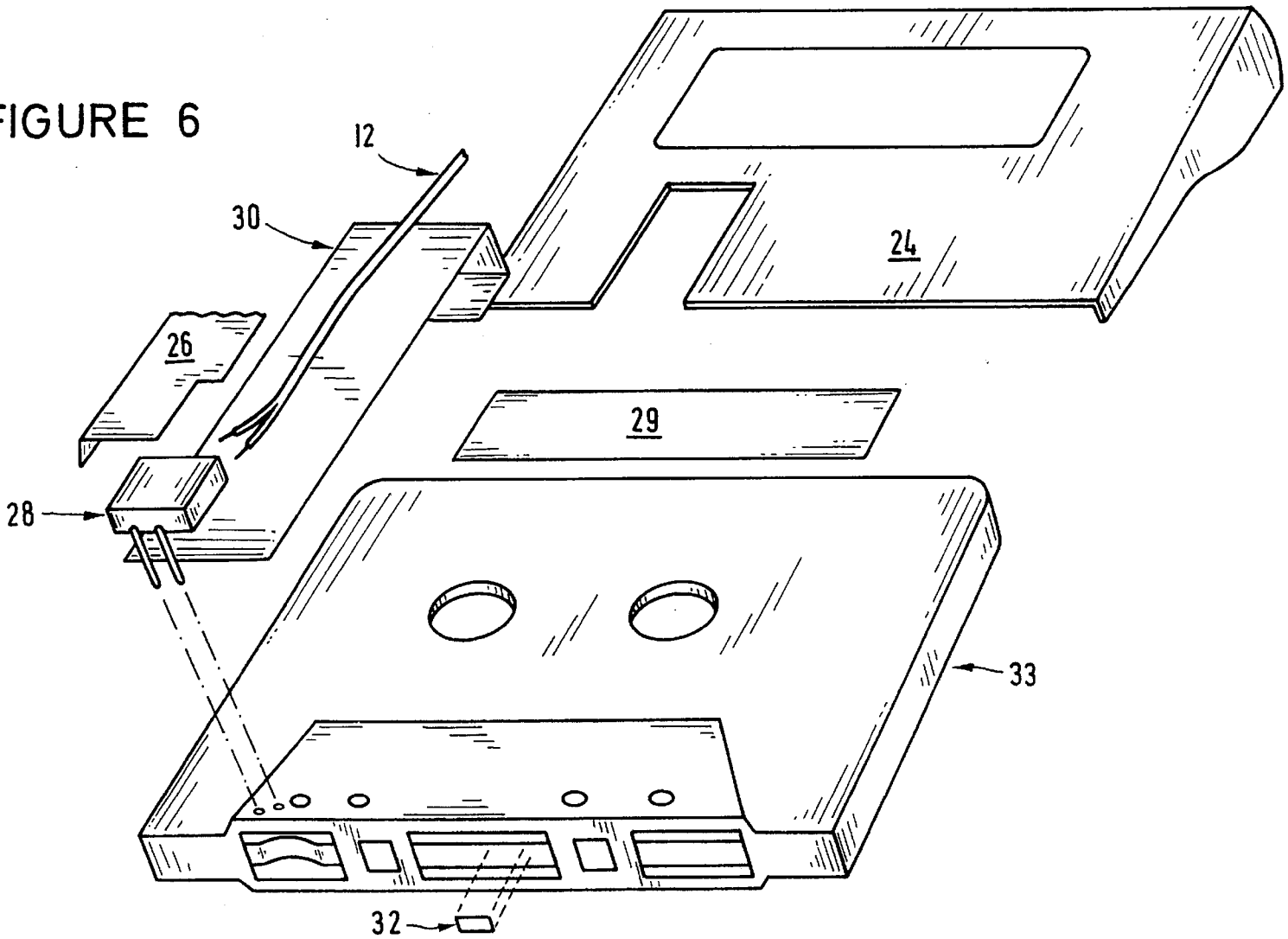

FIG. 6 Exploded View, Tape Sensor

Figure 7C:
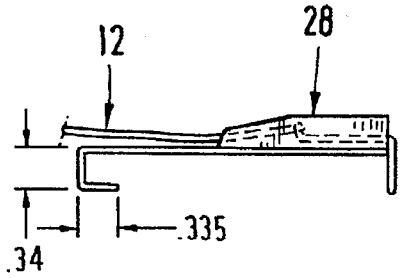
Figure 7B:
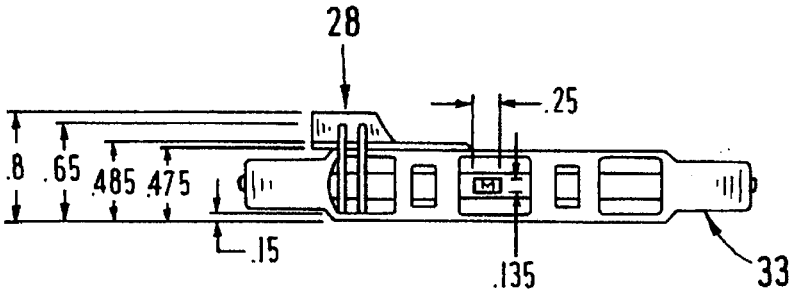
Figure 7A:
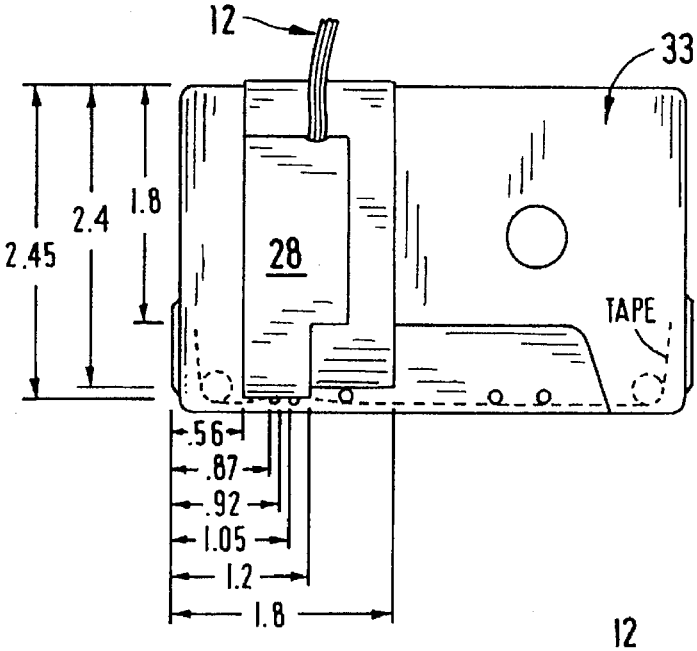
Figure 8:
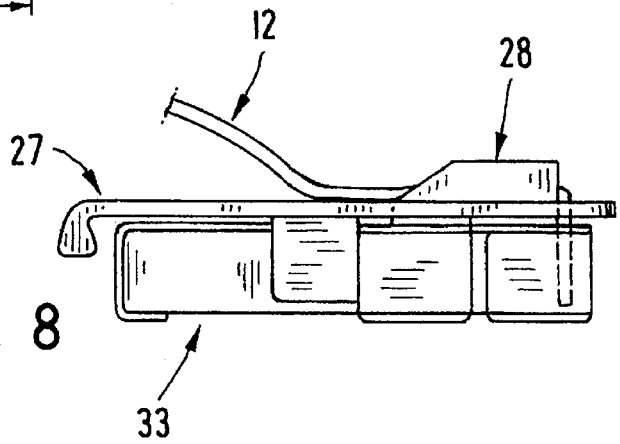
Figure 9C:
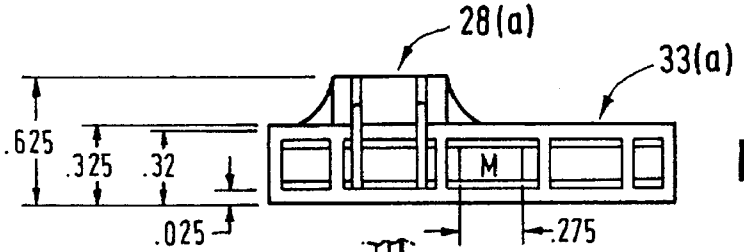
Figure 9B:
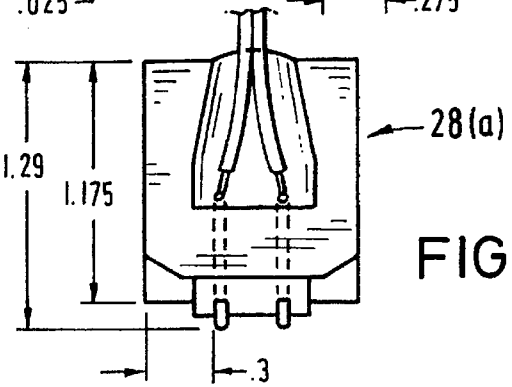
Figure 9A:
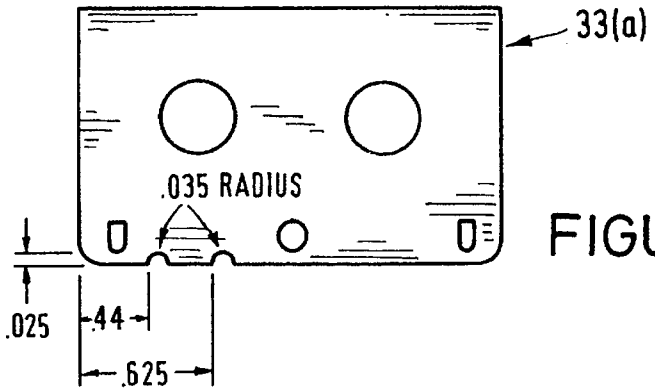
Figure 9E:
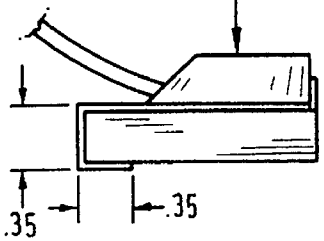
Figure 9D:
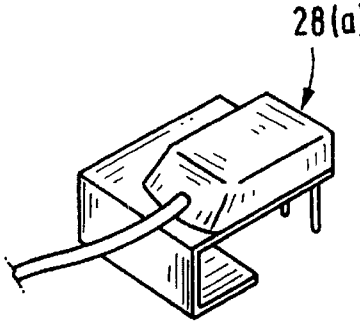
Figure 10:
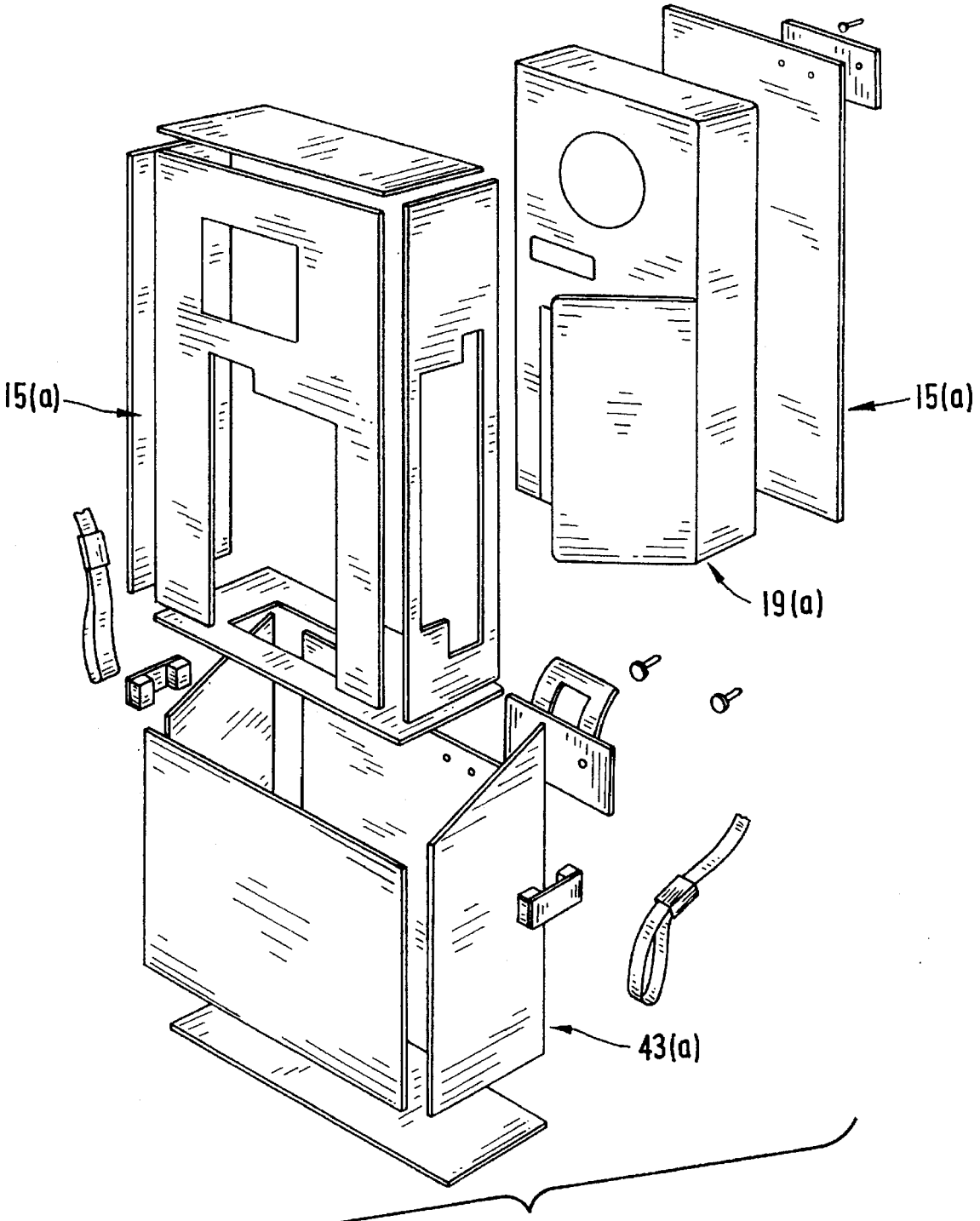

FIGS. 7(*a*), 7(*b*), 7(*c*) show Front, Top, and Side views of Tape Sensor and Tape respectively FIG. 8 Side View of Tape and Tape Sensor Fitting in Tape Recorder Door FIGS. 9(*a*), 9(*b*), 9(*c*), 9(*d*), and 9(*e*) are different views for a Tape Sensor for Micro-Cassette Recorder and Tape FIG. 10 Exploded View, Micro-Cassette Version

REFERENCE NUMERALS IN DRAWINGS

1 Housing Part
2 Mounting Tape Squares (Scotch® Brand, Heavy Duty)
3 Function Switch (Two position, Normally Open Switch On Underside Of Circuit Board)
4 Soldered Electronic Components on Perforated Circuit Boards
5 Wire From Pt.1 on Alarm/Timer to LED Cathode
6 Wire From Pt.2 on Alarm/Timer to LED Anode
7 Power To Tape Recorder Positive Battery Terminal
8 Wire Connecting Alarm/Timer Pt.3 to FET 'Supply'
9 Wire Connecting Alarm/Timer Pt.4 to FET 'Drain'
10 Positive Power Bus
11 Tape Recorder Battery Ground
12 Double Wire
13 Wire
14 Speaker Cut-Out
15 Plastic Housing
16 Alarm Buttons, Time Viewing/Changing Cut-outs
17 Tape Recorder Button Operation Cut-outs
18 Earphone
19 Modified Tape Recorder
20 Housing Part
21 Half of Locking Buckle
22 Rivet
23 "Appointment Monitor" acting as Timer-Alarm
24 Tape Door
25 Tape Sensor Recess Slot
26 Cover Tape
27 Tape Sensor Prongs (Acco® Brand, #1 Silverette Paper Clip)
28 Prong Mounting Block (Plastic)
29 Cassette Label
30 Tape Sensor Bracket (Ductile Copper Sheet)
31 Tape Sensor Mounting Holes
32 Foil Marker
33 Modified Cassette Tape
34 Adjustable Length Clip
35 Strap Mount Bracket (Could Be Riveted On Also)
36 Case
37 Nylon Strap
38 (4) "AA" Battery Holder and Batteries (Flat Holders Only)
39 Tape Counter
40 Bottom Housing Piece
41 Key
42 Cut-out For Viewing Time When Case Is Assembled
43 Lid
44 Red LED (Radio Shack® Catalog No. 276-044)
45 Steel Tube Section, Length: 0.55", Inside Diameter: 0.4"
46 Photoresistor (Radio Shack® Catalog No. 276-196)
47 Cardboard Opaque End Covers With 0.022" Holes Spaced For Component Leads
48 Motorola® MPF 6660 Field Effect Transistor
49 Relay #1, Potter&Bromfield® 3 Volt Relay (Part No. T81NSD212-03)
50 Relay #2, Potter&Bromfield® 3 Volt Relay (Part No. T81NSD212-03)
51 Motorola® MPF 6660 Field Effect Transistor
52 Low power battery

DESCRIPTION FIG. 1

A circuit diagram describing the placement, connections, and types of components in relation to the rest of the device are shown in FIG. 1. The device shown in FIG. 3 is interchangeable for the purposes of this design. The Sony® GVR-500 Mini-VCR, Radio Shack® (CTR-22) Cassette Tape Recorder, Radio Shack® Micro-Cassette Recorder (Catalog No. 14-1175), and like devices are all interchangeable in this circuit.

DESCRIPTION FIG. 2

An exploded view of the entire device is shown in FIG. 2. The device could also be placed in a 'fanny pack' or be worn with a belt clip on the back of the device. Epoxy glue is used to cement the plastic parts of the housing together. ABS or vinyl plastic sheets of between (0.05" and 0.08") may be used. The housing parts could be joined in a dovetailed manner or, preferably, a two part vacuum formed housing is used for increased durability.

Dimensions of the device, with a cassette recorder are shown in FIG. 3 after assembly. A Micro-Cassette Recorder can be substituted for the prior listed devices with the housing shown in FIG. 8.

DESCRIPTION FIGS. 3A and 3B

Wire attachments to Museum Store's®. "Appointment Monitor" (U.S. Pat. No. 4,490,711) 1981, shown in FIGS. 3A and 3B. The Brookstone® "Appointment Keeper" is interchangeable for "Appointment Monitor".

DESCRIPTION FIG. 4

Exploded view of opto-isolator is shown in FIG. 3. Connections of wires X,Z to the LED and wires J,M to the photoresistor 46 are also shown. The opaque end covers 47 are glued with epoxy glue to the ends of the tube 45. The end covers 47 should completely cover the tube ends 45. The leads of the LED 44 and photoresistor 46 components are bent to 90 degrees to placed through the perforated circuit board 4 and soldered to the wires on the other side.

DESCRIPTION FIG. 5

Connections of wires h and K to the tape-recorder's 19 positive and ground battery terminals are shown in FIG. 5. In the case of a recorder having multiple (ground) battery springs and (positive) contacts, the user can quickly determine which one of the positive and negative leads should be connected with the power and ground wire.

DESCRIPTION FIG. 6

An exploded view of the tape sensor in relation to the modified cassette tape 33 with foil markers 32 and tape door 24, with tape sensor recess slot 25, is shown in FIG. 6. The term 'tape sensor' is includes parts 26, 27, 28, and 30. The distance between foil markers 32 defines the duration of play and therefore can be varied is needed. Rolls of conducting foil, with adhesive on back, can be purchased at Radio Shack® and cut to the dimensions shown in the drawing. A paper label 29 on the cassette tape 33 lists the tape segments, in order, and there stop and start points as they would appear on the tape counter 39 if it is cleared when the tape 33 is completely rewound. There are appropriate allowances for the foil markers 32 in these listings.

A foil marker 32 is placed at the beginning and end of each segment and cannot be closer than (0.5) inches apart. Flexible, ductile copper sheet (thickness in drawings) is used to make the tape sensor bracket 30. The bracket 30 has a 'U' in which the back edge of the tape 33 is placed while the user presses the prongs 27 into holes 31 in the tape 33. This is done in reverse to remove the bracket. The bracket 30 can be made by following the dimensions in the drawing and using a cassette, as a form blank, to bend it to the proper shape. The end of the 'U' should fit snugly on the back of the cassette 33.

The prongs 27 are made from (Acco® #1 Silverette Paper Clips). There are two holes taped in the block 28 and then the straightened paper clips are covered wet epoxy, pushed through, allowed to dry, and bent, 90 degrees against the block 18, into prongs 27. The epoxy is removed from the contact areas and the prongs 27 are cut to size. The prongs 17 are then bent into alignment with each other from a side view and may require a one-time adjustment for proper contact. The actual block can be epoxied to the bracket 30. The paper clips protrude from the other side of the block where they are cut, bent in an opposite direction to the prongs 27 and connected to their respective wires 12. The wires 12 should be securely bent around these protrusions and anchored at the rear of the bracket 30, with dover tape 26, ect., so that they are not pulled on as the bracket 30 is used.

DESCRIPTION FIGS. 7(*a*), 7(*b*), AND 7(*c*)

Dimensions of the tape sensor with modified cassette tape 33 are shown in Front, Top, and Side Views in FIGS. 7A, 7B, and 7C.

DESCRIPTION FIG. 8

Side view, using hidden lines, to show how the tape sensor with modified cassette tape 33 fits into the tape door 24 shown in FIG. 7C.

DESCRIPTION FIGS. 9(*a*), 9(*b*), 9(*c*), 9(*d*), AND 9(*e*)

The Front, Top, and Side Views, with dimensions, of the tape sensor for a modified micro-cassette recorder are shown in FIGS. 9(*a*), 9(*b*), 9(*c*), 9(*d*), and 9(*e*).

FIG. 9(*a*) shows the top view of a microcassette 33(*a*). FIG. 9(*b*) shows the top view of a tape sensor 28(*a*) for the microcassette 33(*a*). FIG. 9(*c*) shows the view of the tape sensor 28(*a*) with the micro-cassette 33(*a*). FIGS. 9(*d*) and 9(*e*) show different views of the tape sensor 28(*a*).

DESCRIPTION FIG. 10

An exploded view of the Micro-Cassette version is shown in FIG. 10. The microcassette version includes case 43(*a*), housing 15(*a*), micro cassette recorder 19(*a*).

All drawing dimensions are in inches.

OPERATIONS—FIG. 1

At a pre-designated time, the timer/alarm 23 will send a series of pulses to the RED Led 44. With each pulse, the photresistor 46 allows potential to build on the base of the FET 48, The FET allows the power from the power bus to energize the first relay's 49 coil. The coil is designed to "lock" open as long as power is maintained on the power bus. The tape recorder receives power from the 'open' relay post. Also, a FET 48 allows the timer/alarm's 23 momentary 'stop' to be closed, therefore turning the alarm off after the relay is open. Power is supplied continuously to the power bus by the second relay 50 in it's normal position. The tape sensor acts to energize the second relay 50 when it's prongs 27 are momentarily connected by a foil marker 32 on the passing cassette tape 33. When the second relay 50 is energized, the power bus loses power and the first relay 49 returns to the normal position with no power supplied to the tape recorder 19. The tape 33 moves sufficiently to break the tape sensor's prong's 27 contact with the foil marker 32 before the it stops moving.

An example of a "separate but related" process is when the timer-alarm 23 is engaged in a separate function of keeping, and displaying the time of day and selected alarm times; furthermore, the alarm must act upon those selected times. A second related process, in this device, involves the tape sensor riding on the outside of the tape 33 until a circuit is completed by the tape sensor prongs 27 and foil marker 32 being momentarily connected, thereby, turning the first circuit off. The timer alarm 23 can be considered to be the low power circuit, as these devices contain a low-power watch battery 52 of their own.

The selective signals produces by the time keeping process, which requires a constant supply of low power, can cause the remaining circuit(s) of higher power requirements to engage. Therefore, not keeping circuits powered up when unnecessary, and in the case of separate batteries per section, not drawing off the high power batteries to operated the time keeping functions over long periods of time, which allows for power conservation.

The term "High Power Battery" is defined as those batteries that preform tasks that require higher mounts of power than the other tasks in that system. Power can be a function of time. The same signal sent in a shorter period of time is of higher power than one sent in over a longer period. Even the profile of the signal, at certain instances of time, over a given period can constitute and increase or decrease in power. Therefore, power can be defined as the ability to accomplish work at a given instant in a given circuit.

OPERATIONS—FIG. 2

Preparing The Device For Operation:

The caregiver shall unlock and unbuckle the buckle 40, pulling the lid 43 off the case 36. The 'Stop' button is engaged on the tape recorder 19 and the tapedoor 24 opened. The function switch 3 is placed in the "manual" position (Switch is pressed down to close it.)

A cassette 33 is removed from the door 24 with the tape sensor being pulled off the old cassette. The tape sensor is placed on the side of the new cassette, by placing the prongs 27 in the prepared holes 31, insuring that the tape is behind the prongs when finished. The tape is then slid back into the underside of the tape door with the raised portion of the tape sensor sliding through the tape sensor slot 25 until the tape comes to rest in the tape door 24. The user then closes the tape door and engages the 'Play' switch on the recorder 19. The Function Switch is then placed in the "Auto" position if not already so. With the lid 43 removed, the user observes a series of buttons each for a half hour increment between 8:00 am to 5:30 p.m. on the timer/alarm 23. The time of day is displayed on an LCD display. By pressing anyone of the time switches into the 'On' position, the device will play the tape segment after the last one to be played. The schedule of times is automatically repeated every twenty-four hours. The 'Set' and 'Adv' switch, on the timer/alarm 23, provides a means to change the time of day for the clock function. To create or modify existing tapes, the user must remove the tape sensor, place the function switch 3 into the manual position, go through normal recording operations while watching the tape counter 39 to stay within the limits for the segment.

SUMMARY, RAMIFICATIONS AND SCOPE

Thus the scope of this invention should be determined by the appended claims and their legal equivalents, rather than by the examples given.

I claim:

1. An electronic system comprising:

a first circuit;

a second circuit able to communicate with said first circuit and having a separate energy requirement than said first circuit, said second circuit being selectively activated at times to transmit a signal to said first circuit;

means for connecting said first circuit to an energy source in response to said signal to energize said first circuit to perform a function;

means located in said first circuit for disconnecting said first circuit from said energy source after said function to conserve energy;

and wherein said first circuit includes means for deactivating said second circuit after said first circuit receives said signal for activating said first circuit.

2. The system of claim 1 wherein said circuits have separate energy sources.

3. The system of claim 2 wherein said first circuit is powered by a high-power battery and said second circuit is powered by a low-power battery.

4. The system of claim 2 wherein said first circuit and said second circuit are each powered by a separate battery.

5. The system of claim 1 wherein a control means for said disconnect means is located within said first circuit.

6. An electronic system having a plurality of interconnected circuits comprising:

means for selectively activating a first one of said circuits;

means for transmitting a signal from said first circuit to the other of said circuits after being selectively activated, to connect the other of said circuits to a energy source;

means located within the other of said circuits for deactivating said first one of said circuits after said first one of said circuits receives said signal for activating said other circuit; and means for disconnecting the other of said circuits from said energy source after a period of time has passed to conserve energy.

* * * * *

UNITED STATES PATENT AND TRADEMARK OFFICE

CERTIFICATE OF CORRECTION

PATENT NO. : 5,656,875

DATED : August 12, 1997

INVENTOR(S) : Adam Hutson

It is certified that error appears in the above-indentified patent and that said Letters Patent is hereby corrected as shown below:

On the title page, item [54], and column 1, line 1, change "Independance" to --Independence--.

Item [57], Abstract, line 1, change "independance" to --independence--.

FIG.1, change part labeled as '18' to --'19'--.

Col.1, line 3, change 'Indepcndancc' to --'Independence'--.

Col. 1, line 56, change 'an' to --'a'--.

Col.1, line 58, change 'Mother' to --'Another'--.

Col.1, line 64, change 'process's' to --'processes'--.

Col.1,line 65, change 'combinations' to --'combination'--.

Col.2, line 62, change ',' to --'.'--.

Col.2, line 67, change 'alarm's' to --'alarm'--.

Col.3, line 33, delete 'Pt.3'--.

Col.3, line 34, delete 'Pt.4'--.

Col.3, line 36, add--'Ground' after 'Wire'--.

Col.4, line 2, change 'Assembled' to --'Disassembled'--.

Col.4, line 11, change 'T81NSD212-03' to --'T81N5D212-03'--.

Col.4, line 13, change 'T81NSD212-03' to --'T81N5D212-03'--.

UNITED STATES PATENT AND TRADEMARK OFFICE

CERTIFICATE OF CORRECTION

PATENT NO. :5,656,875

DATED :August 12, 1997

INVENTOR(S) :Adam Hutson

It is certified that error appears in the above-indentified patent and that said Letters Patent is hereby corrected as shown below:

Col.4, lines 36 and 37, delete 'Dimensions of the device, with a cassette recorder are shown in FIG.3 after assembly.'--.

Col.4, line 39, change 'FIG.8' to --'FIG.10'--.

Col.4, line 48, change 'FIG.3' to --'FIG.4'--.

Col.4, line 49, change 'X,Z' to --'5,6'--.

Col.4, line 49, delete 'J,M'--.

Col.4, line 58, change 'h and k' to --'7 and 11'--.

Col.5, line 4, change 'is' to --'as'--.

Col.6, line 6, change '48,' to --'48.'--.

Col.6, line 21, delete 'the'--.

Col.6, line 38, change --'operated' to --'operate'--.

Col.6, line 42, change --'preform' to --'perform'--.

Col.6, line 42, change --'mounts' to -- 'amounts'--.

Col.6, line 45, delete 'in'--.

UNITED STATES PATENT AND TRADEMARK OFFICE

CERTIFICATE OF CORRECTION

PATENT NO. : 5,656,875

DATED : August 12, 1997

INVENTOR(S) : Adam Hutson

It is certified that error appears in the above-indentified patent and that said Letters Patent is hereby corrected as shown below:

Col.6, line 47, change 'and' to –'an'–.

Signed and Sealed this

Fourteenth Day of July, 1998

Bruce Lehman

*Attest:*

BRUCE LEHMAN

*Attesting Officer*

*Commissioner of Patents and Trademarks*